US006481978B2

(12) United States Patent
Zamalis et al.

(10) Patent No.: US 6,481,978 B2
(45) Date of Patent: Nov. 19, 2002

(54) SYSTEM AND METHOD FOR PROTECTING TURBINE AND COMPRESSOR DURING SHUTDOWN

(75) Inventors: Michael H. Zamalis, York, PA (US); Russell A. Tiffany, Hallstead, PA (US); Russell P. Wueschinski, Dover, PA (US)

(73) Assignee: York International Corp., York, PA (US)

( * ) Notice: Subject to any disclaimer, the term of this patent is extended or adjusted under 35 U.S.C. 154(b) by 4 days.

(21) Appl. No.: 09/752,729

(22) Filed: Jan. 3, 2001

(65) Prior Publication Data

US 2002/0085925 A1 Jul. 4, 2002

(51) Int. Cl.[7] ..... F04B 39/06

(52) U.S. Cl. ..... 417/228; 417/405; 184/6.11; 60/39.08

(58) Field of Search ..... 417/199.1, 228, 417/405, 406; 184/6.4, 6.16, 6.11; 60/39.08

(56) References Cited

U.S. PATENT DOCUMENTS 2,751,749 A * 6/1956 Newcomb ..... 60/39.08
2,804,280 A * 8/1957 Wheatley ..... 416/97 R
2,929,217 A * 3/1960 Collman ..... 60/660
3,017,071 A * 1/1962 Lejk et al. ..... 417/359
3,240,424 A 3/1966 Richardson
3,625,020 A * 12/1971 Kimpel et al. ..... 62/158
3,637,048 A * 1/1972 Mount ..... 184/64
3,769,790 A * 11/1973 Thebert ..... 60/39.08
4,144,950 A * 3/1979 Moyer et al. ..... 60/39.08
4,402,180 A * 9/1983 Reid et al. ..... 60/39.08
4,490,622 A * 12/1984 Osborn ..... 417/406
4,629,033 A 12/1986 Moore et al.
4,888,947 A * 12/1989 Thompson ..... 60/39.08
4,891,934 A * 1/1990 Huelster ..... 184/6.4
4,930,600 A * 6/1990 Kumar et al. ..... 184/6.4
5,018,601 A * 5/1991 Waddington et al. ..... 184/6.4
5,180,034 A * 1/1993 Lopes ..... 184/6.11
5,184,456 A * 2/1993 Rumford et al. ..... 60/39.08
5,310,020 A 5/1994 Martin et al.
5,735,676 A * 4/1998 Loos ..... 417/407
6,139,280 A * 10/2000 Holt et al. ..... 184/6.4

OTHER PUBLICATIONS

The Electric Tachometer Corporation, Aug. 29, 1999, The Electric Tachometer Corporation, 6 pages.*
T. C. Dickenson, 1995, Elsevier Science Ltd, Pumping Manual 9$^{th}$ Edition, 3 pages.*

* cited by examiner

*Primary Examiner*—Charles G. Freay
*Assistant Examiner*—John F Belena
(74) *Attorney, Agent, or Firm*—Brian T. Sattizahn; Carmen Santa Maria; McNees Wallace & Nurick LLC

(57) ABSTRACT

A system and associated method for protecting during a shutdown a turbine having a turbine shaft and a compressor driven by the turbine shaft. The system include a first lubrication system, a second lubrication system, and a control system. The first lubrication system is configured to provide lubrication to the compressor. The second lubrication system is configured to provide lubrication to the turbine. The control system monitors the rotation of the turbine shaft in response to a shutdown request and causes the first and second lubrication systems to provide lubrication to the turbine and compressor until and after the turbine shaft stops rotating. The control system causes the first lubrication system to provide lubrication for a first predetermined period of time after the turbine shaft stops rotating. The control system causes the second lubrication system provides lubrication for a second predetermined period of time after the turbine shaft stops rotating. If the turbine shaft starts to rotate any time after it has stopped, the control system causes the first and second lubrication systems to provide lubrication to the turbine and compressor until and after the turbine shaft stops rotating again.

36 Claims, 5 Drawing Sheets

SYSTEM AND METHOD FOR PROTECTING TURBINE AND COMPRESSOR DURING SHUTDOWN

BACKGROUND OF THE INVENTION

This invention generally relates to systems and methods for shutting down turbines and compressors. More particularly, the present invention relates to a system and method for shutting down a turbine and an associated compressor and for protecting the turbine and compressor through selective lubrication.

Turbines and compressors typically include rotating shafts supported by bearings. These rotating shafts and bearings generate friction heat that needs to be removed to maintain their physical integrity. Lubrication, generally oil, is supplied between the rotating shafts and bearings to remove the friction heat. Lubrication should continue during all operating phases to avoid shaft or bearing failures that lead to an unscheduled downtime.

The need for lubrication continues even after motive powers are removed from turbines and compressors in response to a shutdown request. Instead of stopping instantaneously, a rotating shaft gradually slows to a stop after a motive power is removed. For example, a rotating shaft in a steam-driven turbine continues to rotate for a period of time after the steam supply to the turbine stops. Likewise, a rotating shaft in an electric-motor-driven compressor continues to rotate for a period of time after the electric power is removed. Thus, turbines and compressors need lubrication until their rotating shafts slow to a stop in response to a shutdown request.

One conventional approach to meet this need is maintaining lubrication for a fixed period of time after a shutdown request. In this conventional approach, one estimates the time for a rotating shaft to stop and then sets the fixed period of time based on the estimated time. This approach, however, does not ensure that a rotating shaft receives lubrication while it is rotating. In other words, lubrication to a rotating shaft ceases at the end of a fixed period of time regardless of the actual time for the rotating shaft to stop. Therefore, a rotating shaft and its corresponding bearing may be physically damaged if, for any reason, it rotates after the fixed period of time.

SUMMARY OF THE INVENTION

Accordingly, an object of the present invention is directed to an improved system and method for protecting during a shutdown a turbine and a compressor driven by a turbine shaft, particularly a turbine and associated compressor used in a refrigeration, air-conditioning, or heat pump system. The advantages and purposes of the invention will be set forth in part in the description which follows, and in part will be obvious from the description, or may be learned by practice of the invention. The advantages and purposes of the invention will be realized and attained by the elements and combinations particularly pointed out in the appended claims.

To attain the advantages and in accordance with the purposes of the invention, as embodied and broadly described herein, the invention is directed to a system for protecting during a shutdown a turbine having a turbine shaft and a compressor driven by the turbine shaft. The system includes a first lubrication system, a second lubrication system, and a control system. The first lubrication system is configured to provide lubrication to the compressor. The second lubrication system is configured to provide lubrication to the turbine. The control system monitors the rotation of the turbine shaft in response to a shutdown request and causes the first and second lubrication systems to provide lubrication to the turbine and compressor until and after the turbine shaft stops rotating.

In another aspect, the invention is directed to a method for protecting during a shutdown a turbine having a turbine shaft and a compressor driven by the turbine shaft. The method includes the steps of: (a) initiating the shutdown of the turbine and compressor; (b) monitoring the rotation of the turbine shaft; (c) providing lubrication to the turbine and compressor until the turbine shaft stops rotating; and (d) providing lubrication to the turbine and compressor after the turbine shaft stops rotating.

It is to be understood that both the foregoing general description and the following detailed description are exemplary and explanatory only and are not restrictive of the invention, as claimed.

BRIEF DESCRIPTION OF THE DRAWING

The accompanying drawings, which are incorporated in and constitute a part of this specification, illustrate one embodiment of the invention and together with the description, serve to explain the principles of the invention. In the drawings.

DETAILED DESCRIPTION

Reference will now be made in detail to the presently preferred embodiment of the present invention, examples of which are illustrated in the accompanying drawings. Wherever possible, the same reference numbers will be used throughout the drawings to refer to the same or like parts. An exemplary embodiment of a system of the present invention is shown in FIG. 1 and designated generally by reference number 20.

In accordance with the present invention, there is provided a system for protecting during a shutdown a turbine having a turbine shaft and a compressor driven by the turbine shaft. The system includes a first lubrication system, a second lubrication system, and a control system. The first lubrication system is configured to provide lubrication to the compressor. The second lubrication system is configured to provide lubrication to the turbine. The control system monitors the rotation of the turbine shaft in response to a shutdown request and causes the first and second lubrication systems to provide lubrication to the turbine and compressor until and after the turbine shaft stops rotating. As explained in greater detail below, if the turbine shaft starts to rotate any time after it has stopped, the control system causes the first and second lubrication systems to provide lubrication to the turbine and compressor until and after the turbine shaft stops rotating again. Preferably, the turbine is a steam turbine and the compressor is a centrifugal compressor. However, it is contemplated that the system of the present invention may be used in a wide variety of turbines and compressors and is by no means limited to a specific type of turbine or compressor.

Figure 1:
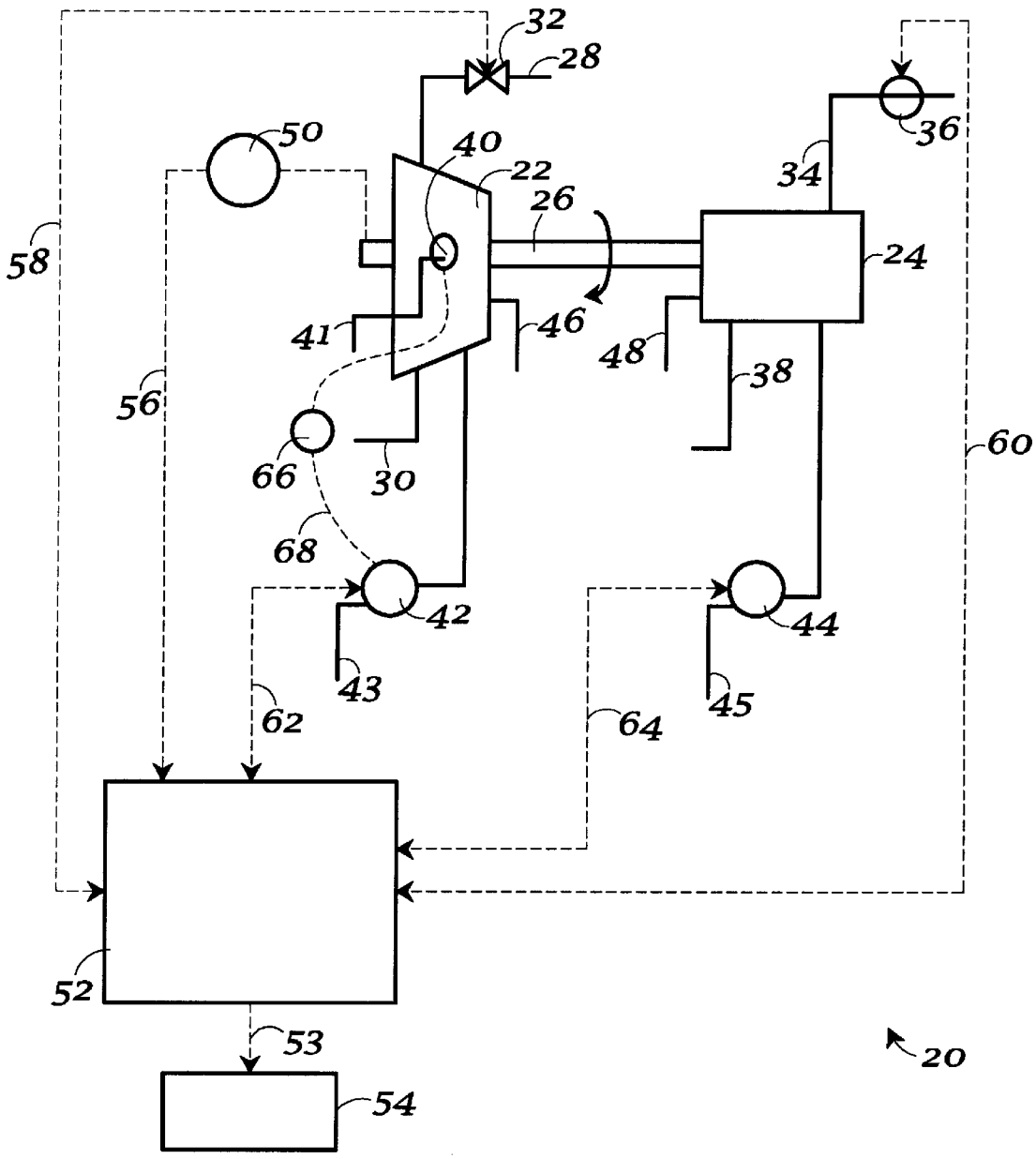
FIG. 1 is a schematic diagram of a system for protecting a turbine and a turbine-driven compressor in accordance with the present invention.

As illustrated in FIG. 1, system 20 includes a turbine 22 and a compressor 24. Turbine 22 has a turbine shaft 26, which rotates in response to a motive fluid expanding within turbine 22. The motive fluid is provided to turbine 22 from a turbine inlet line 28. Turbine inlet line 28 includes a valve 32 that is movable from an open position to a closed position to stop the flow of the motive fluid to turbine 22. The motive fluid expanded through turbine 22 to rotate turbine shaft 26 is discharged through a turbine outlet line 30. Preferably, the motive fluid is steam but the present invention encompasses the use of a gas, or any other type of motive fluid. Depending on the type of motive fluid used, a corresponding type of turbine, either a steam turbine or a gas turbine, needs to be used as well.

Compressor 24 is coupled to and driven by turbine shaft 26. Preferably, compressor 24 is a centrifugal compressor although the present invention encompasses other types of compressors, including reciprocating or scroll-type compressors. Compressor 24 receives an operating fluid through a compressor inlet line 34.

Compressor inlet line 34 includes pre-rotation vanes 36. Pre-rotation vanes 36 are movable from an open position to a closed position to substantially stop the flow of operating fluid to compressor 24. As is well known in the art, pre-rotation vanes 36 in the closed position, however, do not completely stop the flow of operating fluid to compressor 24. Pre-rotation vanes 36 may also operate in intermediate positions to vary the capacity of compressor 24. Compressor 24 increases the pressure of the operating fluid and discharges it to a condenser (not shown) through a compressor outlet line 38. Compressor 24 may be a component of an air-conditioning system, refrigeration system, or heat pumps.

As shown in FIG. 1, system 20 further includes lubrication systems providing lubrication to turbine 22 and compressor 24. The lubrication systems include a turbine lubrication system and a compressor lubrication system. The turbine lubrication system provides lubrication to turbine 22 and includes a turbine lubrication oil pump 40 and an auxiliary turbine lubrication oil pump 42. The compressor lubrication system provides lubrication to compressor 24 and includes a compressor lubrication oil pump 44. Turbine lubrication oil pump 40 is driven by turbine shaft 26. Preferably, turbine lubrication oil pump 40 is internal to turbine 22 although the present invention encompasses a pump external to turbine 22 as well. Preferably, auxiliary turbine lubrication oil pump 42 and compressor lubrication oil pump 44 are electrical pumps.

Lines 41 and 43 respectively connect pumps 40 and 42 to a single reservoir (not shown), which holds a supply of oil or other lubricants suitable for turbine 22. Line 45 connects compressor lubrication pump 44 to another reservoir (not shown), which holds a supply of oil or other lubricants suitable for compressor 24. Turbine 22 and compressor 24 return oil or other lubricants to their respective reservoirs through respective lines 46 and 48.

As shown in FIG. 1, system 20 further includes a control system that includes a tachometer 50, a microprocessor 52 or a similar electronic control, and a control panel 54. Tachometer 50 is coupled to turbine shaft 26 to detect its rotation. Preferably, tachometer 50 is a digital tachometer suitable for a low RPM detection. The RPM signal from tachometer 50 is transmitted through line 56 to microprocessor 52. Microprocessor 52 includes a central processor (not shown) and memory (not shown) and can take a variety of forms as is known in the art. Microprocessor 52 also receives signals indicating operating positions of valve 32 and pre-rotation vanes 36 through respective lines 58 and 60. Microprocessor 52 may also transmit signals through lines 58 and 60 to change the operating positions of valve 32 and pre-rotation vanes 36. Microprocessor 52 is also connected to auxiliary turbine lubrication oil pump 42 and compressor lubrication oil pump 44 through respective lines 62 and 64. Signals indicating whether pumps 42 and 44 are on are transmitted to microprocessor 52 through lines 62 and 64 as well. Also, microprocessor 52 may transmit signals through lines 62 and 64 either to start or to stop pumps 42 and 44.

Turbine lubrication oil pump 40 and auxiliary turbine lubrication oil pump 42 are connected directly over a line 68 via a pressure switch 66. Pressure switch 66 starts auxiliary turbine lubrication oil pump 42 automatically when the pressure of turbine lubrication oil pump 40 drops below a predetermined value. As turbine shaft 26 slows down to a stop in response to a system shutdown request, turbine lubrication oil pump 40, which is driven by turbine shaft 26, loses its capability to provide oil. Thus, when the pressure of turbine lubrication oil pump 40 drops below the predetermined value, pressure switch 66 starts auxiliary turbine lubrication oil pump 42 by closing an electric contact (not shown), and thereby connecting auxiliary turbine lubrication oil pump 42 to its power line (not shown). Preferably, the predetermined value is about 8 p.s.i., although the present invention encompasses the use of different predetermined values. Different predetermined values may be selected depending on the capacity of turbine 22 and turbine lubrication oil pump 40.

Alternatively, instead of pressure switch 66, a control signal from microprocessor 52 may automatically start auxiliary turbine lubrication oil pump 42 when the pressure of turbine lubrication oil pump 40 drops below the predetermined value. In this alternative configuration, microprocessor 52 receives a signal from a pressure sensor (not shown) in or associated with turbine lubrication oil pump 40.

While system 20 is in normal operating conditions, turbine lubrication oil pump 40 and compressor lubrication oil pump 44 provide oil to turbine 22 and compressor 24, respectively. Auxiliary turbine lubrication oil pump 42 is off while system 20 is in normal operating conditions. When microprocessor 52 receives a system shutdown request, microprocessor 52 sends a signal over line 60 to close pre-rotation vanes 36 to unload compressor 24 from turbine shaft 26. After microprocessor 52 recognizes the closure of pre-rotation vanes 36, it sends a signal over line 58 to close valve 32 so that the flow of the motive fluid to turbine 22 stops. Microprocessor 52 may start to monitor the rotation of turbine shaft 26, detected by tachometer 50 through line 56, when it receives a shutdown request, when pre-rotation vanes 36 close, or when valve 32 closes. Alternatively, microprocessor 52, through tachometer 50, may constantly monitor the rotation of turbine shaft 26 before and after the shutdown request. Regardless, microprocessor 52 and tachometer 50 continue to monitor and detect the rotation of turbine shaft 26 throughout the application of the system and method of the present invention.

Figure 2:
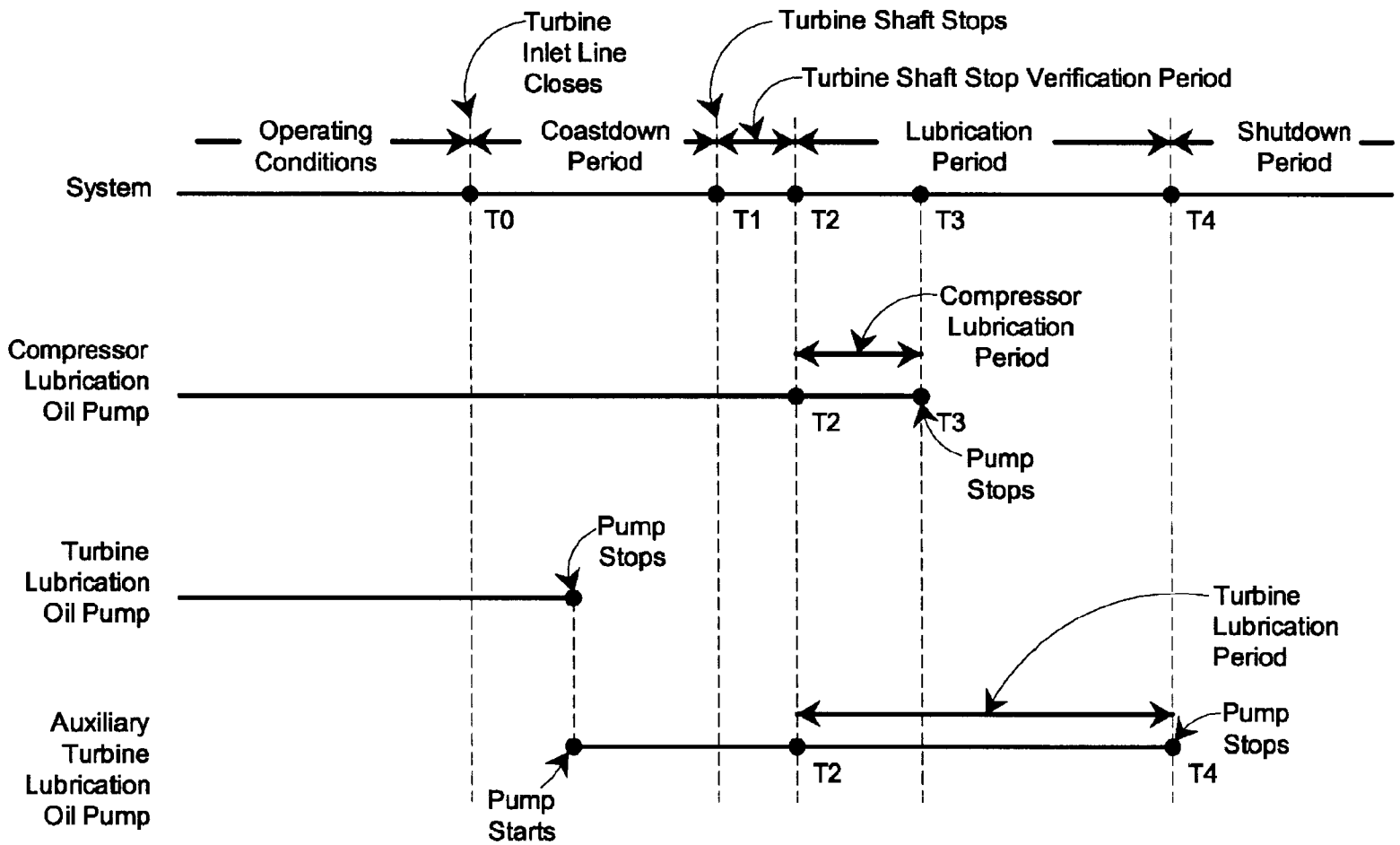
FIGS. 2 and 3 are schematic diagrams illustrating time lines of shutdown sequences in accordance with the present invention.

As shown in FIGS. 1 and 2, when valve 32 closes to stop the flow of the motive fluid to turbine 22 at time T0, system 20 enters a coastdown period during which turbine shaft 26 is allowed to slow down at its own rate to a stop at time T1. During this coastdown period between T0 and T1, compressor lubrication oil pump 44 continues to provide oil to compressor 24. However, as turbine shaft 26 slows, the pressure of turbine lubrication oil pump 40 decreases to a predetermined value (e.g., 8 p.s.i.) below which turbine lubrication oil pump 40 does not adequately provide oil to turbine 22. As previously mentioned, when the pressure of turbine lubrication oil pump 40 drops below the predetermined value, auxiliary turbine lubrication oil pump 42 is automatically started to provide oil to turbine 22. In the preferred embodiment disclosed, auxiliary turbine lubrication oil pump 42 is automatically activated by pressure switch 66. Auxiliary turbine lubrication oil pump 42 can alternatively be turned on and off by a control signal from microprocessor 52, the microprocessor in turn being connected to a pressure sensor (not shown) in or associated with turbine lubrication oil pump 40.

The coastdown period is limited to a predetermined safe period of time that is more than sufficient for the shaft 26 of a given turbine to slow down to a stop after valve 32 closes. By means of example only, the predetermined safe period of time of about 10 minutes can be used for typical HVAC systems, although it can vary depending on the type of turbine selected for a particular system. If turbine shaft 26 does not slow down to a stop within the predetermined safe period of time after valve 32 closes, microprocessor 52 sends a signal over a line 53 to control panel 54 to display a turbine default warning message informing operating personnel that a manual intervention is required.

Figure 3:
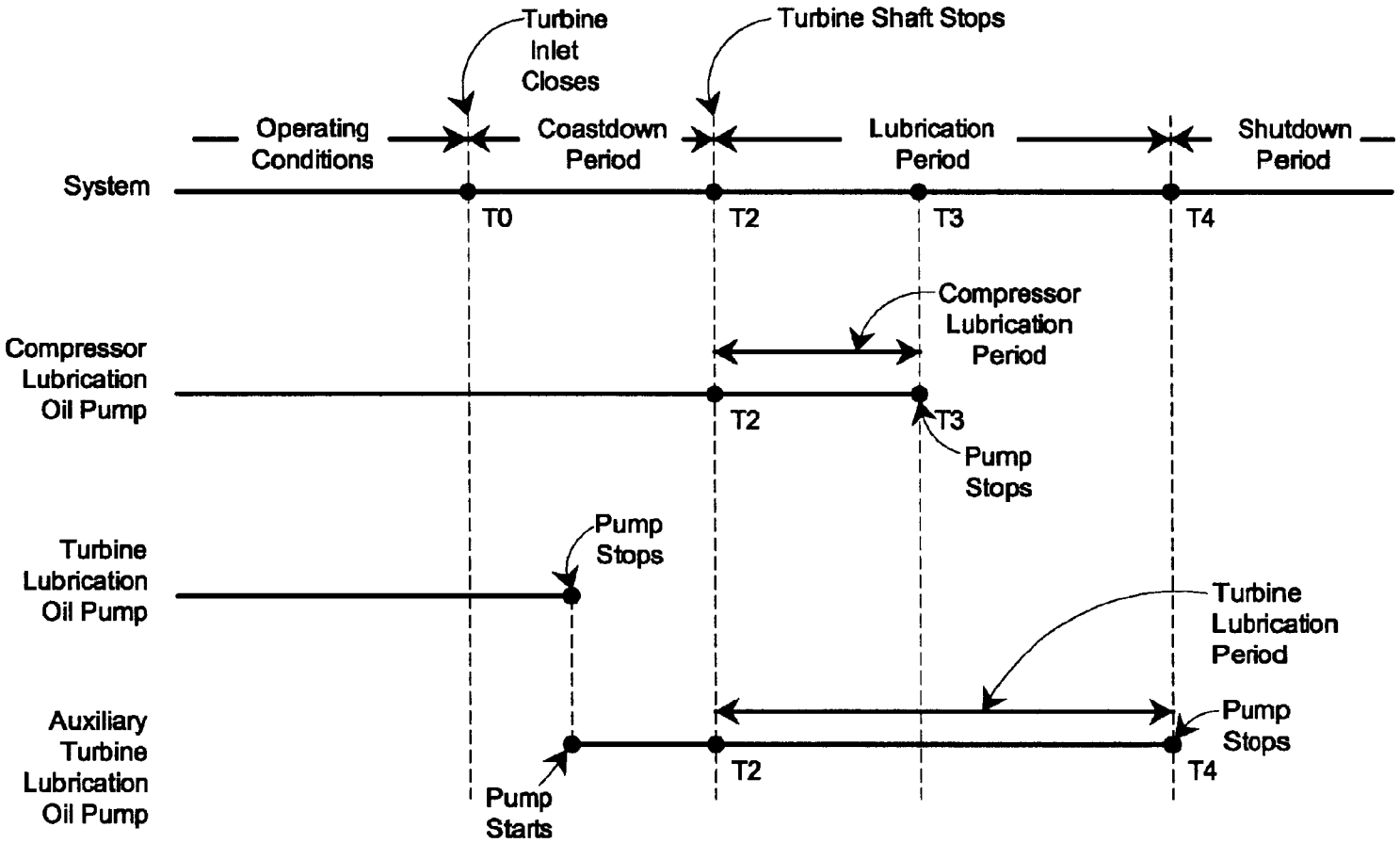

When turbine shaft 26 slows down to a stop at time T1, microprocessor 52 receives a signal from tachometer 50 indicating that turbine shaft 26 has stopped rotating. At the same time, microprocessor 52 initiates a turbine shaft stop verification period. The turbine shaft stop verification period between T1 and T2 is provided to ensure that turbine shaft 26 actually comes to a stop. During the turbine shaft stop verification period, if tachometer 50 detects that turbine shaft 26 starts to rotate again, microprocessor 52 reinitiates the coastdown period and system 20 restarts at time T0. After the turbine shaft stop verification period, microprocessor 52 initiates a lubrication period at time T2. For a typical turbine-compressor for HVAC applications, a turbine shaft stop verification period of about 5 seconds is acceptable. The present invention, however, encompasses the lubrication period that is initiated without the turbine shaft stop verification period (FIG. 3). As will be explained in greater detail below, the turbine shaft stop verification period is not required given the fact that system 20 reverts to the condition existing at time T0 whenever tachometer 50 detects turbine shaft 26 rotating again after initially coming to a stop.

As shown in FIGS. 1, 2, and 3, when turbine shaft 26 stops rotating, the lubrication period is initiated at time T2 and lasts until time T4. The lubrication period between T2 and T4 includes a compressor lubrication period and a turbine lubrication period. Preferably, the compressor lubrication period and the turbine lubrication period are initiated at the same time. Alternatively, the compressor lubrication period and the turbine lubrication period may be initiated at different times as long as they are initiated after turbine shaft 26 stops rotating. Preferably, the turbine lubrication period between T2 and T4 is longer than the compressor lubrication period between T2 and T3. For example, for a typical turbine-compressor used in an HVAC system, the turbine lubrication period is about 30 minutes while the compressor lubrication period is about 35 seconds.

Compressor lubrication oil pump 44, which has been providing oil to compressor 24 all along, continues to provide oil to compressor 24 during the compressor lubrication period. At the end of the compressor lubrication period at time T3, microprocessor 52 stops compressor lubrication oil pump 44 and thereby terminates the compressor lubrication period. Auxiliary turbine lubrication oil pump 42, which has been providing lubrication oil to turbine 22 since the pressure of turbine lubrication oil pump 44 dropped below a predetermined pressure value, continues to provide oil to turbine 22 during the turbine lubrication period. At the end of the turbine lubrication period at time T4, microprocessor 52 stops auxiliary turbine lubrication oil pump 42 and thereby terminates the turbine lubrication period. Thereafter, system 20 enters a shutdown period during which oil is provided to neither turbine 22 nor compressor 24, unless the rotation of turbine shaft 26 is sensed by tachometer 50 and sent to microprocessor 52.

As previously mentioned, microprocessor 52 monitors the rotation of turbine shaft 26 detected by tachometer 50 throughout the application of the system and method of the present invention. In other words, microprocessor 52 and tachometer 50 respectively monitor and detect the rotation of turbine shaft 26 throughout the coastdown period, the turbine shaft stop verification period (if used), the lubrication period including the compressor lubrication period and the turbine lubrication period, and the shutdown period.

If turbine shaft 26 starts to rotate any time after the end of the coastdown period (T1 in FIG. 2 and T2 in FIG. 3) and before a restart of system 20 is initiated, entire system 20 reverts to the condition existing at time T0. Then, system 20 repeats the coastdown period, the turbine shaft stop verification period (if used), the lubrication period including the compressor lubrication period and the turbine lubrication period, and the system shutdown period.

Before system 20 reverts to the condition existing at time T0, however, microprocessor 52 ensures that both compressor lubrication oil pump 44 and auxiliary turbine lubrication oil pump 42 are operating. In other words, if turbine shaft 26 starts to rotate after the coastdown period but before the end of the compressor lubrication period (between T1 and T3 in FIG. 2 and between T2 and T3 in FIG. 3), system 20 reverts to the condition existing at time T0 without microprocessor 52 starting neither compressor lubrication oil pump 44 nor auxiliary turbine lubrication oil pump 42 because they have never been stopped. If turbine shaft 26 starts to rotate after the compressor lubrication period but before the end of the turbine lubrication period (between T3 and T4 in FIG. 2 as well as in FIG. 3), system 20 reverts to the condition existing at time T0 and microprocessor 52 starts compressor lubrication oil pump 44, which has been stopped at the end of the compressor lubrication period. If turbine shaft 26 starts to rotate after the end of the turbine lubrication period (after T4 in FIG. 2 as well as in FIG. 3), system 20 reverts to the condition existing at time T0 and microprocessor 52 starts both compressor lubrication oil pump 44 and auxiliary turbine lubrication oil pump 42, which have been stopped at the end of the compressor lubrication period and at the end of the turbine lubrication period, respectively.

As previously mentioned, the coastdown period is limited to a predetermined safe period of time, for example about 10 minutes. Thus, if turbine shaft 26 does not stop rotating within the predetermined safe period of time, microprocessor 52 sends a signal over a line 53 to control panel 54 to display a turbine default warning message informing operating personnel that a manual intervention is required. The operating personnel may then investigate the cause of the continued rotation of turbine shaft 26 and take necessary steps to remove the cause. In case of instrumentation failures, for example, the failure of tachometer 50, the operating personnel may take necessary steps to shutdown the system manually for subsequent maintenance or remedial actions.

In the preferred embodiment, microprocessor 52 sends signals to control panel 54 to display appropriate messages corresponding to the coastdown period, the turbine shaft stop verification period (if used), the compressor lubrication period, the turbine lubrication period, and the shutdown period. The messages displayed on control panel 54 inform operating personnel of the system conditions after a shutdown request. For example, "COMPRESSOR COASTDOWN; TURBINE COASTDOWN" message may be displayed on control panel 54 between T0 and T3 (FIG. 2). Between T3 and T4, "COMPRESSOR SHUTDOWN; TURBINE COASTDOWN" may be displayed. After T4, "SYSTEM SHUTDOWN" message may be displayed. In these examples, "COASTDOWN" message indicates that oil is being provided to the corresponding component while "SHUTDOWN" message indicated that oil is not being provided to the corresponding component. It should be noted, however, the foregoing messages are examples only. Many different messages informing operating personnel of the system conditions may be displayed. The messages may be accompanied by other directions for operating personnel to follow for more information or further actions.

The operation of the aforementioned system and method for shutting down a turbine and a compressor driven by the turbine will now be described with reference to the attached drawings.

Figure 4A:
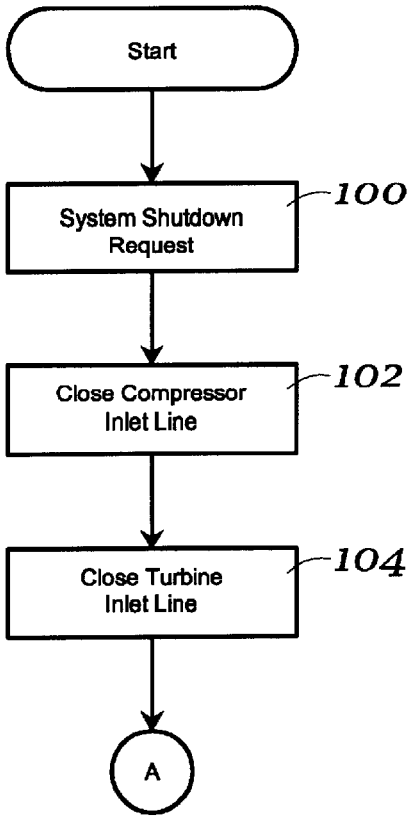
FIGS. 4A through 4D set forth a flow chart illustrating shutdown sequences in accordance with the present invention.

As shown in FIGS. 1 and 4A, while system 20 is in normal operating conditions, turbine lubrication oil pump 40 and compressor lubrication oil pump 44 provide oil to turbine 22 and compressor 24, respectively. When microprocessor 52 receives a system shutdown request as indicated at 100, microprocessor 52 sends a signal over line 60 to close pre-rotation vanes 36 as indicated at 102. The shutdown request can be inputted by an operator at control panel 54, or the request can be a signal from a main control for the HVAC system or one of its components. Subsequently, when pre-rotation vanes 36 close, microprocessor 52 sends a signal over line 58 to close valve 32 as indicated at 104 so that the flow of the motive fluid to turbine 22 stops. As previously mentioned, microprocessor 52 starts or continues to monitor the rotation of turbine shaft 26 detected by tachometer 50 through line 56. That is, the system of the present invention may constantly monitor the rotation of turbine shaft 26, or only monitor the rotation after a shutdown request is made.

Figure 4B:
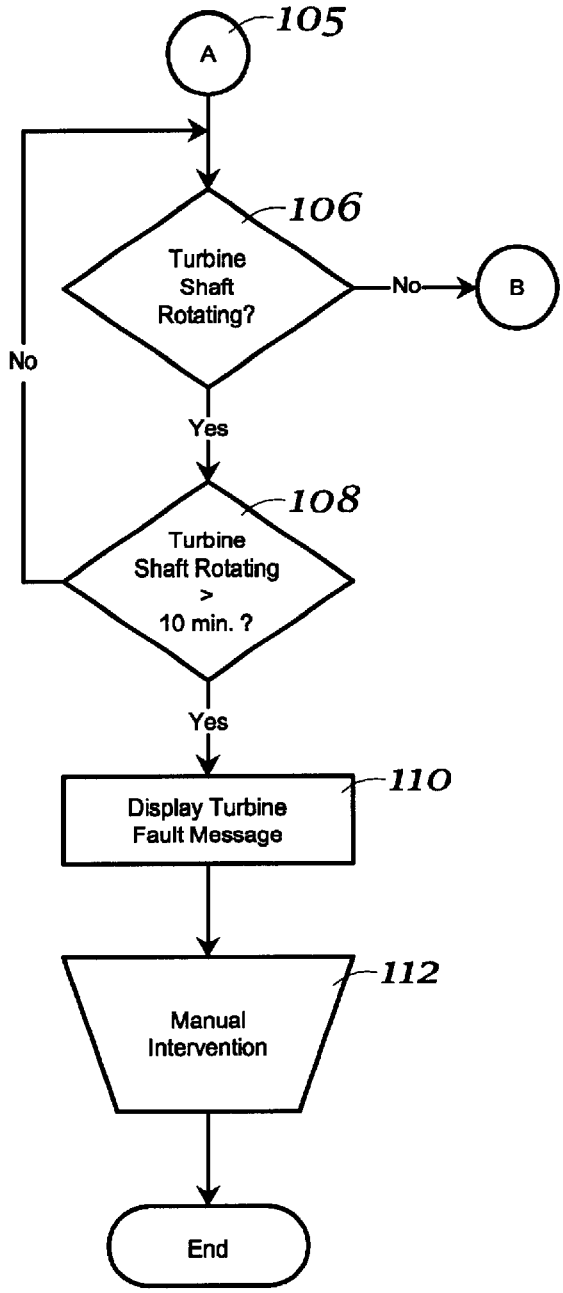

As shown in FIGS. 1 and 4B, with the motive fluid removed from turbine 22, system 20 enters a coastdown period during which turbine shaft 26 is allowed to slow down to a stop at its own rate. During this coastdown period, compressor lubrication oil pump 44 continues to provide oil to compressor 24. However, as turbine shaft 26 slows, the pressure of turbine lubrication oil pump 40 decreases to a predetermined value below which turbine lubrication oil pump 40 does not adequately provide oil to turbine 22. The predetermined value will be selected depending on the capacity and lubrication need of turbine 22 and the capacity of turbine lubrication oil pump 40. When the pressure of turbine lubrication oil pump 40 drops below the predetermined pressure value (e.g., 8 p.s.i.), pressure switch 66, or alternatively microprocessor 52, starts auxiliary turbine lubrication oil pump 42 automatically to provide oil to turbine 22. Preferably, the system is configured so that auxiliary lubrication oil pump 42 automatically starts whenever the pressure of turbine lubrication oil pump 40 or oil output falls below the safe predetermined level. Then, if turbine lubrication oil pump 40 fails during normal operating conditions, auxiliary turbine lubrication oil pump 42 will protect turbine 22. Preferably, microprocessor 52 will be designed to sense such a condition and provide the user with a message, indicating that turbine lubrication oil pump 40 is not operating correctly and that auxiliary turbine lubrication oil pump 42 has been activated to protect turbine 22.

Figure 4C:
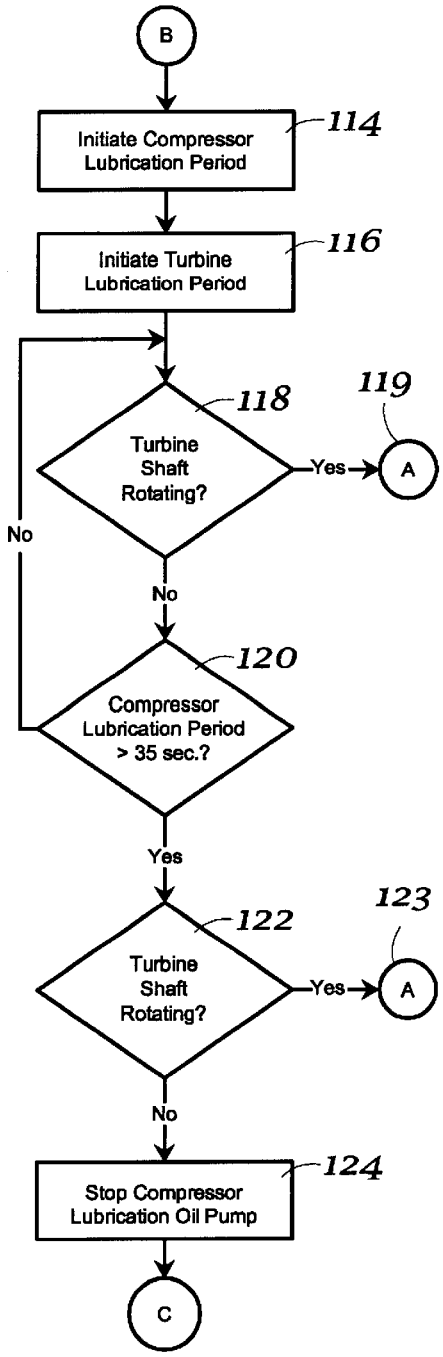

As indicated at 106, microprocessor 52 monitors the rotation of turbine shaft 26 during the coastdown period through tachometer 50. When tachometer 50 detects that turbine shaft 26 stops rotating, microprocessor 52 initiates a lubrication period, which includes a compressor lubrication period indicated at 114 and a turbine lubrication period indicated at 116 (FIG. 4C). As indicated at 108, the coastdown period is limited to a predetermined safe period of time calculated based on a period greater than the estimated time for turbine shaft 26 to slow down to a stop after valve 32 closes. The predetermined safe period of time will vary depending on the type of turbine selected for a particular system. If turbine shaft 26 does not slow down to a stop within the predetermined safe period of time (e.g. about 10 minutes) after valve 32 closes, microprocessor 52 will display a turbine default warning message on control panel 54 as indicated at 110. The turbine default message prompts operating personnel into a manual intervention as indicated at 112.

As shown in FIGS. 1 and 4C, if turbine shaft 26 slows down to a stop within the predetermined safe period of time, microprocessor 52 terminates the coastdown period and initiates a lubrication period, which includes a compressor lubrication period indicated at 114 and a turbine lubrication period indicated at 116. Preferably, the compressor lubrication period and the turbine lubrication period are initiated at the same time although they may be initiated at different times as long as they are initiated promptly after turbine shaft 26 stops rotating. Also, the turbine lubrication period is preferably longer than the compressor lubrication period. For example, the turbine lubrication period for a conventional HVAC system is about 30 minutes, while the compressor lubrication period is about 35 seconds.

During the compressor lubrication period, compressor lubrication oil pump 44 continues to provide oil to compressor 24. After about 35 seconds as indicated at 120, microprocessor 52 terminates the compressor lubrication period by stopping compressor lubrication oil pump 44 as indicated at 124. If turbine shaft 26 starts to rotate anytime during the compressor lubrication period for any reason, microprocessor 52 reinitiates the coastdown period as indicated at 119 and 123 to restart the shutdown sequence at 105 (FIG. 4B). If turbine shaft 26 starts to rotate anytime after the compressor lubrication period for any reason (FIG. 4D), microprocessor 52 starts compressor lubrication oil pump 44, which has been stopped at the end of the compressor lubrication period and restarts the shutdown sequence at 105 (FIG. 4B). Starting compressor lubrication oil pump 44 as indicated at 130, 136, and 142 ensures that oil is provided to compressor 24 whenever turbine shaft 26 is rotating.

Figure 4D:
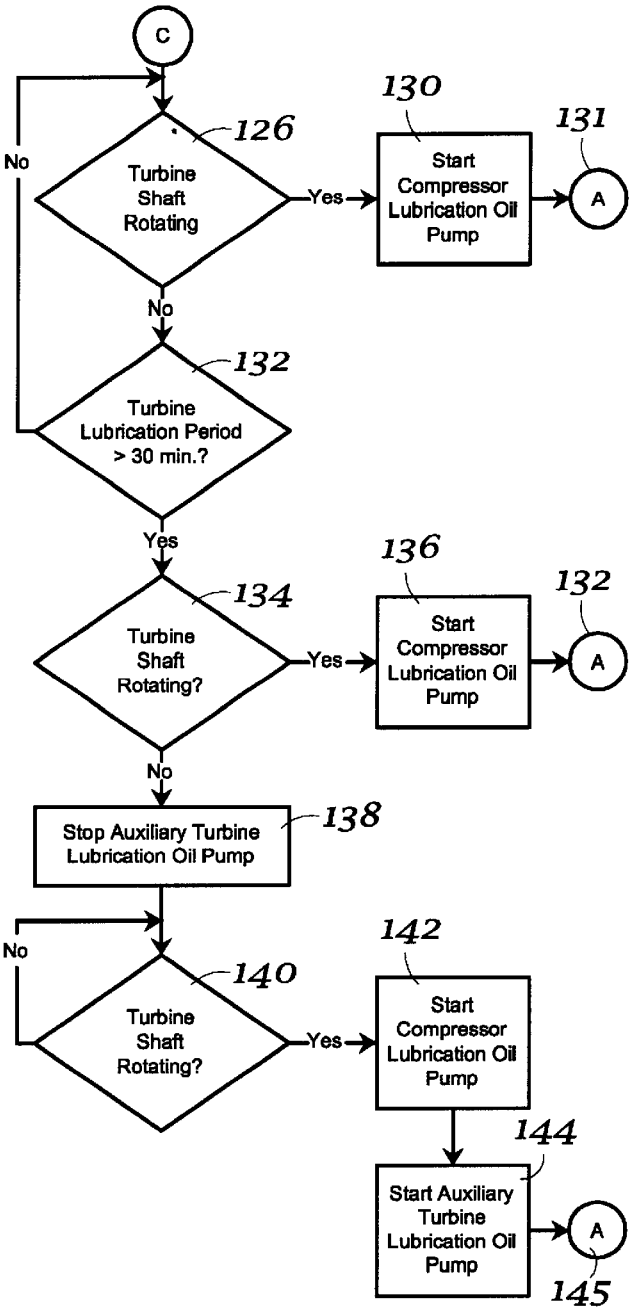

As shown in FIGS. 1 and 4D, during the turbine lubrication period, auxiliary turbine lubrication oil pump 42, which has been automatically started during the coastdown period, continues to provide oil to turbine 22. After about 30 minutes as indicated at 132, microprocessor 52 terminates the turbine lubrication period by stopping auxiliary turbine lubrication oil pump 42 as indicated at 138. System 20 then enters a shutdown period during which oil is provided to neither turbine 22 nor compressor 24. Microprocessor 52 and tachometer 50, however, continue to monitor and detect turbine shaft 26 for rotation during the shutdown period.

If turbine shaft 26 starts to rotate anytime after the turbine lubrication period for any reason, microprocessor 52 starts auxiliary turbine lubrication oil pump 42, which has been stopped at the end of the turbine lubrication period and restarts the shutdown sequence at 105 (FIG. 4B). Starting auxiliary turbine lubrication oil pump as indicated at 144 ensures that oil is provide to turbine 22 whenever turbine shaft 26 is rotating.

It should be appreciated that the present invention protects against the potentially harmful effect resulting from any unexpected rotation of turbine shaft 26 after a shutdown request. By initiating and reinitiating the lubrication period when the rotation of turbine shaft 26 stops, the present invention ensures that oil is provided to turbine 22 and compressor 24 not only when turbine shaft 26 is rotating but also for a period of time after turbine shaft 26 stops rotating. Thus, the present invention protects turbine 22 and compressor 24 against the friction heat generated during the rotation of turbine shaft 26 and any latent heat remaining after turbine shaft 26 stops rotating.

The control of the present invention can either be incorporated into the main control of the turbine and compressor, or the HVAC control of the system of which the turbine and compressor are a part, or into a separate control for the described system of the present invention. Various types of software and hardware can be used to practice the invention, as will be apparent to those skilled in the art.

It will be apparent to those skilled in the art that various modifications and variations can be made in the device of the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A system for protecting during a shutdown a turbine having a turbine shaft and a compressor driven by the turbine shaft, comprising:

a first lubrication system to provide lubrication to the compressor;

a second lubrication system to provide lubrication to the turbine; and a control system to monitor the rotation of the turbine shaft in response to a shutdown request and to cause the first and second lubrication systems to provide lubrication to the compressor and turbine until and after the turbine shaft stops rotating.

2. The system of claim 1, wherein the control system causes the first lubrication system to provide lubrication to the compressor for a first predetermined period of time after the turbine shaft stops rotating and causes the second lubrication system to provide lubrication to the turbine for a second predetermined period of time after the turbine shaft stops rotating.

3. The system of claim 2, wherein the second predetermined period of time is longer than the first predetermined period of time.

4. The system of claim 3, wherein the first predetermined period of time is less than 1 minute.

5. The system of claim 3, wherein the second predetermined period of time is more than 10 minutes.

6. The system of claim 1, wherein the control system provides a turbine fault warning if the turbine shaft does not stop rotating within a predetermined safe period of time after the shutdown request.

7. The system of claim 6, wherein the predetermined safe period of time is about 10 minutes.

8. The system of claim 1, wherein, if the turbine shaft starts to rotate any time after it has stopped, the control system causes the first and second lubrication systems to provide lubrication to the turbine and compressor until and after the turbine shaft stops rotating again.

9. The system of claim 1, further comprising a turbine inlet line configured to provide a motive fluid to the turbine and a compressor inlet line configured to provide an operating fluid to the compressor.

10. The system of claim 9, further comprising a valve movable from an open position to a closed position to stop the flow of the motive fluid to the turbine.

11. The system of claim 9, further comprising pre-rotation vanes movable from an open position to a closed position to substantially stop the flow of the operating fluid to the compressor.

12. The system of claim 1, wherein the control system includes a tachometer to monitor the rotation of the turbine shaft.

13. The system of claim 12, wherein the tachometer is a digital tachometer suitable for a low RPM detection.

14. The system of claim 1, wherein the compressor is a centrifugal compressor.

15. The system of claim 1, wherein the control system includes a microprocessor.

16. The system of claim 1, wherein the first lubrication system includes a compressor lubrication oil pump to provide lubrication to the compressor.

17. The system of claim 16, wherein the second lubrication system includes a turbine lubrication oil pump driven by the turbine shaft and an auxiliary turbine lubrication oil pump to provide lubrication to the turbine.

18. The system of claim 17, further comprising a switch that starts the auxiliary turbine lubrication oil pump when the output of the turbine lubrication oil pump drops below a predetermined value.

19. The system of claim 18, wherein the switch is a pressure switch.

20. The system of claim 17, wherein the turbine lubrication oil pump is internal to the turbine.

21. The system of claim 17, wherein the compressor lubrication oil pump and the auxiliary turbine lubrication oil pump are electrical pumps.

22. The system of claim 1, wherein the control system further includes a control panel to display system messages.

23. A method for protecting during a shutdown a turbine having a turbine shaft and a compressor driven by the turbine shaft, comprising the steps of:

(a) initiating the shutdown of the turbine and compressor;

(b) monitoring the rotation of the turbine shaft;

(c) providing lubrication to the turbine and compressor until the turbine shaft stops rotating; and (d) providing lubrication to the turbine and compressor after the turbine shaft stops rotating.

24. The method of claim 23, wherein lubrication is provided to the compressor for a first predetermined period of time after the turbine shaft stops rotating and lubrication is provided to the turbine for a second predetermined period of time after the turbine shaft stops rotating.

25. The method of claim 24, wherein the second predetermined period of time is longer than the first predetermined period of time.

26. The method of claim 25, wherein the first predetermined period of time is less than 1 minute.

27. The method of claim 25, wherein the second predetermined period of time is more than 10 minutes.

28. The method of claim 23, wherein a compressor lubrication oil pump provides lubrication to the compressor during the first predetermined period of time and an auxiliary turbine lubrication oil pump provides lubrication to the turbine during the second predetermined period of time.

29. The method of claim 28, wherein a turbine lubrication oil pump coupled to the turbine shaft provides lubrication to the turbine initially during the shutdown of the turbine and the auxiliary turbine lubrication oil pump provides lubrication to the turbine when the output of the turbine lubrication oil pump drops below a predetermined value.

30. The method of claim 29, wherein the output of the turbine lubrication oil pump is determined by monitoring the pressure of the turbine lubrication oil pump.

31. The method of claim 30, wherein the auxiliary turbine lubrication oil pump is turned on when the monitored pressure falls below 8 p.s.i.

32. The method of claim 23, further comprising the step of providing a turbine fault warning, if the turbine shaft does not stop rotating within a predetermined safe period of time after the shutdown is initiated.

33. The method of claim 32, wherein the predetermined safe period of time is about 10 minutes.

34. The method of claim 23, wherein, if the turbine shaft starts to rotate any time after it has stopped, the steps (c) and (d) are reinitiated and performed.

35. The method of claim 23, further comprising the steps of:

substantially stopping a flow of an operating fluid to the compressor; and stopping a flow of a motive fluid to turbine to the turbine.

36. The method of claim 35, wherein the step of stopping the flow of the motive fluid to the turbine is performed after the step of substantially stopping the flow of the operating fluid to the compressor.

* * * * *